US008497752B2

(12) United States Patent
An

(10) Patent No.: US 8,497,752 B2
(45) Date of Patent: Jul. 30, 2013

(54) MOVABLE CONTACTOR ASSEMBLY FOR CURRENT LIMITING TYPE CIRCUIT BREAKER

(75) Inventor: Byeong Su An, Chungcheongbuk-Do (KR)

(73) Assignee: LSIS CO., Ltd., Anyang-Si, Gyeonggi-Do (KR)

( * ) Notice: Subject to any disclaimer, the term of this patent is extended or adjusted under 35 U.S.C. 154(b) by 0 days.

(21) Appl. No.: 13/341,347

(22) Filed: Dec. 30, 2011

(65) Prior Publication Data

US 2012/0169440 A1 Jul. 5, 2012

(30) Foreign Application Priority Data

Jan. 3, 2011 (KR) ..... 10-2011-0000262

(51) Int. Cl.
*H01H 9/20* (2006.01)

(52) U.S. Cl.
USPC ..... 335/167; 335/16

(58) Field of Classification Search
USPC ..... 335/16, 22
See application file for complete search history.

(56) References Cited

U.S. PATENT DOCUMENTS

| | | | | |
|---|---|---|---|---|
| 5,310,971 | A * | 5/1994 | Vial et al. | 200/244 |
| 5,313,180 | A * | 5/1994 | Vial et al. | 335/16 |
| 5,510,761 | A * | 4/1996 | Boder et al. | 335/172 |
| 6,262,642 | B1 * | 7/2001 | Bauer | 335/16 |
| 6,366,438 | B1 * | 4/2002 | Bauer | 361/115 |
| 6,791,440 | B2 * | 9/2004 | Harmon et al. | 335/16 |
| 7,005,594 | B2 * | 2/2006 | Kim | 200/244 |
| 7,145,419 | B2 * | 12/2006 | Kim | 335/16 |
| 7,189,935 | B1 * | 3/2007 | Hassan et al. | 200/244 |
| 7,977,592 | B2 * | 7/2011 | Shmukler et al. | 200/244 |
| 2006/0077022 | A1 | 4/2006 | Kim | |

FOREIGN PATENT DOCUMENTS

| | | |
|---|---|---|
| EP | 1600988 | 11/2005 |
| EP | 2085988 | 8/2009 |
| FR | 2891661 | 4/2007 |
| JP | 62-163237 | 7/1987 |
| JP | 11-144598 | 5/1999 |
| JP | 2002-522888 | 7/2002 |
| JP | 2005-509252 | 4/2005 |
| WO | 03/041105 | 5/2003 |

OTHER PUBLICATIONS

Japan Patent Office Application Serial Number 2011-286613, Office Action dated Feb. 7, 2013, 2 pages.

* cited by examiner

*Primary Examiner* — Elvin G Enad
*Assistant Examiner* — Lisa Homza
(74) *Attorney, Agent, or Firm* — Lee, Hong, Degerman, Kang & Waimey

(57) ABSTRACT

A movable contactor assembly for a current limiting type circuit breaker comprises a movable contactor having a pair of curved protrusions having cam profiles, a shaft to rotatably support the movable contactor located therein, a pair of contact levers each having a contact surface contactable with the curved protrusion of the movable contactor and a pair of spring supporting recess portions and a pair of springs each having both end portions supported by the spring supporting recess portions, the pair of springs applying an elastic force as contact pressure for maintaining a contact state between the movable contactor and the stationary contactor when the movable contactor is located at the first position, and applying the elastic force in a direction to separate the movable contactor from the stationary contactor when the movable contactor is moved over a dead point while rotating toward the second position.

5 Claims, 2 Drawing Sheets

MOVABLE CONTACTOR ASSEMBLY FOR CURRENT LIMITING TYPE CIRCUIT BREAKER

CROSS-REFERENCE TO RELATED APPLICATION

Pursuant to 35 U.S.C. §119(a), this application claims the benefit of earlier filing date and right of priority to Korean Application No. 10-2011-0000262, filed on Jan. 3, 2011, the contents of which are hereby incorporated by reference herein in its entirety.

BACKGROUND OF THE INVENTION

1. Field of the Invention

This disclosure relates to a current limiting type circuit breaker, and particularly, to a movable contactor assembly for the current limiting type circuit breaker.

2. Background of the Invention

A current limiting type circuit breaker includes stationary contactors each having a "U" shape and has a configuration that an incoming current direction via the stationary contactor and an outgoing current direction via a movable contactor are opposite to each other. Hence, the structure of the current limiting circuit breaker is suitable for performing a current limiting operation that when a large fault current, such as a short-circuit current, flows on a circuit, the electromagnetic forces generated around the movable contactor and the stationary contactor cause electromagnetic repulsive forces and accordingly the movable contactor is automatically separated from the stationary contactor to limit the current flow amount.

In the current limiting circuit breaker, a movable contactor having a double-contacts structure having contacts at both ends thereof is being frequently used because the movable contactor having the double-contacts structure allows for a faster current limiting operation by virtue of a stronger electromagnetic repulsive force than a movable contactor with a single-contacts structure.

In addition to the current limiting operation, for maintaining a contact state between the movable contactor and the stationary contactor while a normal current flows on a circuit, a movable contactor assembly in the current limiting circuit breaker includes springs for providing contact pressure to the movable contactor, and connection pins for transferring elastic forces of the springs to the movable contactor.

An example of the related art movable contactor assembly in the current limiting circuit breaker may be Korean Patent Application No. 10-0574788 (Title of the Invention: Contactor Assembly for Circuit Breaker) filed by the applicant of this disclosure.

The related art provides a movable contactor assembly having a self-centering structure of supporting a movable contactor at a shaft without a movable contactor center pin. This is a configuration of guiding the contact pin which moves to a current limiting position or a contact position. The configuration has a characteristic that a pair of cam plates are installed on an inner wall of the shaft.

However, the related art movable contactor assembly includes a roller for smooth friction between the cam plates and the contact pin, a pair of springs disposed on each one surface of the shaft, links, the cam plates and the like. The complicated structure and many components lower assembly productivity and increase fabricating costs. Furthermore, erroneous operations, such as torsion or separation, are caused after assembling those many components due to accumulation of air gaps among those many components.

As another example of the related art movable contactor assembly for the current limiting circuit breaker may be Korean Registered Patent No. 10-0606424 (Title of the Invention: Movable contactor assembly for Current Limiting Circuit Breaker) filed and registered by the applicant of this disclosure.

In order to maintain a movable contactor in a state separated from a stationary contactor by a current limiting operation until performing a trip operation by a trip mechanism and a switching mechanism, the related art movable contactor assembly according to the Korean Registered Patent No. 10-0606424 includes contact plates for transferring elastic forces of springs to the movable contactor, and a convex portion having a flat surface and a curved surface for providing a guide surface of the contact plates to the movable contactor.

The related art movable contactor assembly according to the Korean Registered Patent No. 10-0606424 especially has a center shaft of the movable contactor installed for preventing a rotation center of the movable contactor from being moved during a current limiting operation in a self-centering structure.

However, in the another example of the related art, a pair of springs are disposed for each one surface of the movable contactor at both sides based on the center shaft for prevention of interference and balancing between the center shaft and the springs. A pair of supporting pins for each one surface of the movable contactor are also disposed to support one end of each spring. With regard to this configuration, the many number of springs and spring supporting pins lower assembly productivity and increase fabricating costs.

SUMMARY OF THE INVENTION

Therefore, to address those problems of the related art, an aspect of the detailed description is to provide a movable contactor assembly for a current limiting type circuit breaker capable of exhibiting a fast current limiting property, maintaining a separated state of a movable contactor from a stationary contactor until performing a trip operation after a current limiting operation, and ensuring high assembly productivity and low fabricating costs by virtue of reduction of the number of springs and spring supporting pins.

Another aspect of the detailed description is to provide a movable contactor assembly for a current limiting type circuit breaker capable of preventing a rotation center of a movable contactor from being moved during a current limiting operation and avoiding interference between springs and a movable contactor center pin.

To achieve these and other advantages and in accordance with the purpose of this disclosure, as embodied and broadly described herein, there is provided a movable contactor assembly for a current limiting type circuit breaker having a current limiting type stationary contactor, the movable contactor assembly comprising a movable contactor having a pair of curved protrusions having cam profiles, respectively, symmetrically formed at upper and lower surfaces thereof, the movable contactor being rotatable to a first position contacting the current limiting type stationary contactor, and a second position separated from the current limiting type stationary contactor by an electromagnetic repulsive force upon occurrence of a large fault current on a circuit, wherein the movable contactor has contacts at both end portions thereof;

a shaft to rotatably support the movable contactor located therein, the shaft having a pair of spring receiving recess portions formed at outer surfaces along a central portion thereof;

a pair of contact levers each having a contact surface contactable with the curved protrusion of the movable contactor and a pair of spring supporting recess portions, the pair of contact levers being symmetrically installed based on the movable contactor;

a pair of springs each having both end portions supported by the spring supporting recess portions of the corresponding contact lever, received in the spring receiving recess portions of the shaft, and provided respectively at both plate surfaces of the movable contactor, the pair of springs applying an elastic force as contact pressure for maintaining a contact state between the movable contactor and the current limiting type stationary contactor when the movable contactor is located at the first position, and applying the elastic force in a direction to separate the movable contactor from the current limiting type stationary contactor when the movable contactor is moved over a dead point while rotating toward the second position; and contact lever pins inserted through the contact levers, respectively, such that both ends thereof are supported by the shaft so as to provide rotation supporting points to the corresponding contact levers, wherein each cam profile of the movable contactor comprises a first curved surface to receive, via the contact lever, the elastic force of the spring applied toward the contact of the movable contactor when the movable contactor is located at the first position;

a second curved surface to receive, via the contact lever, the elastic force of the spring, which starts to be applied in a direction close to a center shaft of the movable contactor, other than toward the contact of the movable contactor, while the movable contactor is rotated from the first position toward the second position, the second curved surface being located closer to the contact of the movable contactor than the first curved surface; and a third curved surface to receive, via the contact lever, the elastic force of the spring applied toward the center shaft of the movable contactor while the movable contactor is rotated from the first position toward the second position, the third curved surface being located closer to the contact of the movable contactor than the second curved surface.

In another aspect of this disclosure, the movable contactor may include a first center shaft hole portion formed in a shape of a long hole at a central position in a lengthwise direction and a height direction thereof, and the shaft may include a second center shaft hole portion formed at a central portion thereof. Here, the movable contactor assembly may further include a movable contactor center pin to support the movable contactor for prevention of separation and eccentric state, the movable contactor center pin being inserted into the first center shaft hole portion of the movable contactor and the second center shaft hole portion of the shaft.

In another aspect of this disclosure, a length of the movable contactor center pin is shorter than a length of the second center shaft hole portion of the shaft for prevention of interference between the movable contactor center pin and the springs.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this disclosure, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

Figure 1:
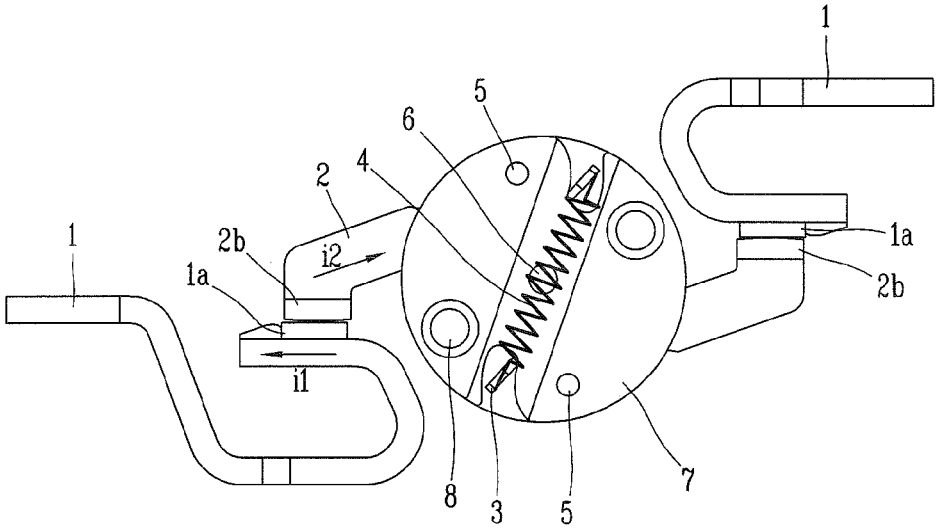
FIG. 1 is a side view showing a configuration of a movable contactor assembly for a current limiting type circuit breaker in accordance with an exemplary embodiment.

A movable contactor assembly for a current limiting type circuit breaker, as shown in FIG. 1, has been designed for a current limiting type circuit breaker having a current limiting type stationary contactor 1 (hereinafter, referred to as 'stationary contactor). The stationary contactor 1 has a "U" shape similar to the related art and has a contact 1*a* at one end. The stationary contactor 1 has a structure that a direction of a current $i_1$ incoming via the stationary contactor is opposite to a direction of a current $i_2$ outgoing via a movable contactor 2.

Typically, an industrial current limiting type circuit breaker is a 3-phases alternating current (AC) circuit breaker, so three movable contactor assemblies are installed in one current limiting type circuit breaker. Similarly, for a 4-phases (in other words 4 poles) current limiting type circuit breaker, four movable contactor assemblies may be installed in one current limiting type circuit breaker.

Although three or four movable contactor assemblies are installed in one current limiting type circuit breaker, each movable contactor assembly has the same configuration and operation. Hence, FIGS. 1 to 4 exemplarily show one representative movable contactor assembly. Hereinafter, description will be given of configuration and operation of the one representative movable contactor assembly.

Referring to FIG. 1, each movable contactor assembly for a current limiting circuit breaker according to an exemplary embodiment may comprise a movable contactor 2, a shaft 7, a pair of contact levers 3, a pair of springs 4 and a pair of contact lever pins 5.

In FIG. 1, a reference numeral 8 designates a pair of driving pins which receive a rotational force from a switching mechanism (not shown) to rotate the shaft 7.

The other components, except for a terminal part of the stationary contactor 1, which is externally exposed for connection of an electric power line for each phase (pole), namely, components including movable contactor 2, the shaft 7, the pair of contact levers 3, the pair of springs 4 and the pair of contact lever pins 5, may be hermetically received within an outer casing (not shown) made of synthetic resin having electric insulating property for inter-phase electric insulation.

Figure 2:
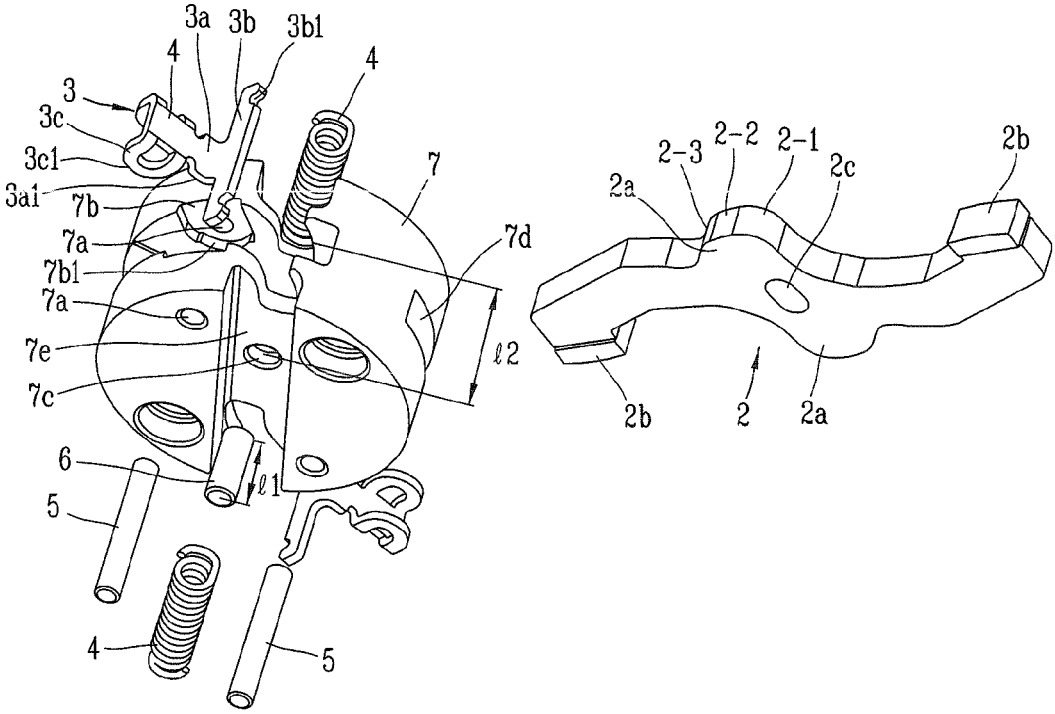
FIG. 2 is a disassembled perspective view of the movable contactor assembly for the current limiting type circuit breaker in accordance with the exemplary embodiment.
Figure 3:
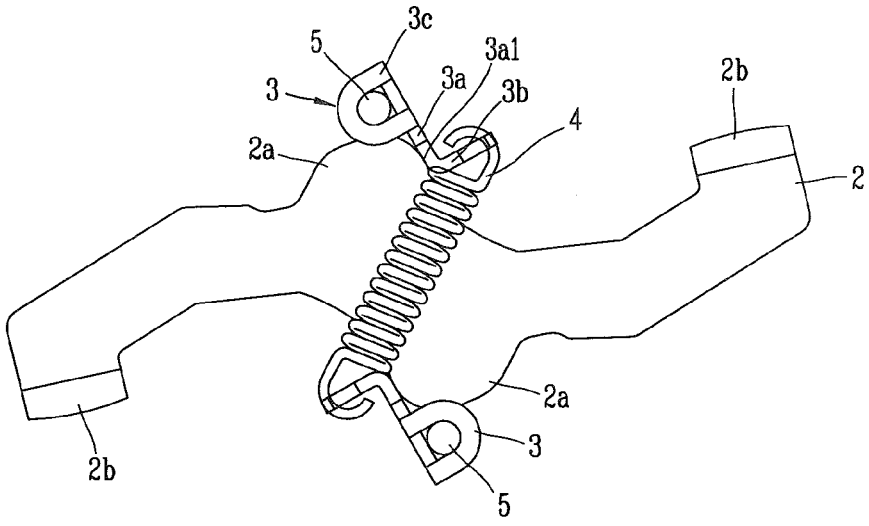
FIG. 3 is a side view showing a partial configuration of the movable contactor assembly for the current limiting type circuit breaker, which shows an interconnection of a movable contactor, a curved protrusion of the movable contactor, contact levers, contact lever pins and a spring.

Referring to FIG. 2, the movable contactor 2 may be a conductive metal plate having both ends with contacts 2*b*. The movable contactor 2 may include a first center shaft hole portion 2*c* formed in form of a long hole at a central position of a plate surface in a lengthwise direction to allow for passing through of a movable contactor center pin 6.

The movable contactor 2 may include a pair of curved protrusions 2*a* formed at upper and lower surfaces thereof symmetrical to each other and respectively having cam profiles.

Figure 4:
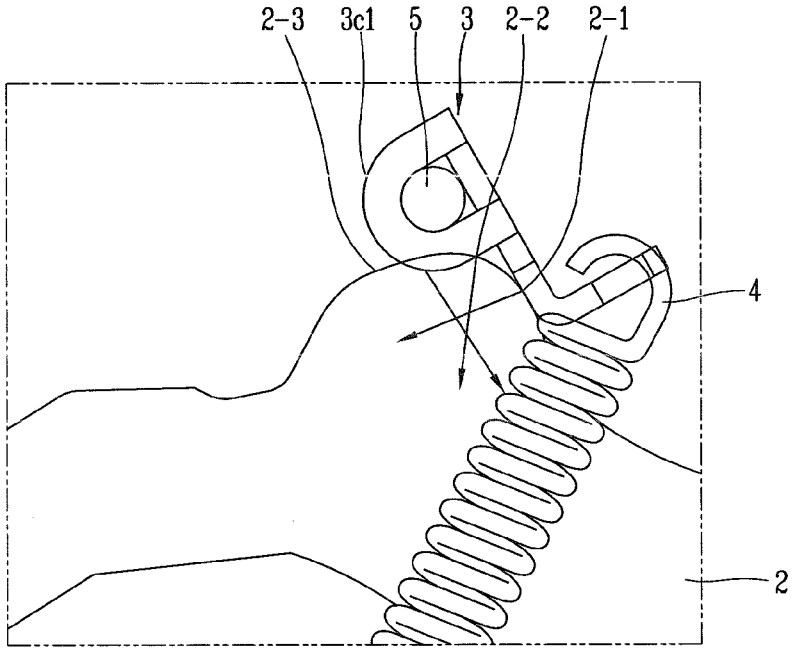
FIG. 4 is an operational view of the movable contactor assembly for the current limiting type circuit breaker in accordance with the exemplary embodiment, which shows the configuration of the curved protrusion of the movable contactor and a direction to provide an elastic force of the spring according to a contact position between the corresponding curved protrusion and the contact lever.

Each cam profile of the movable contactor 2, as shown in FIG. 4, may include a first curved surface 2-1, a second curved surface 2-2 and a third curved surface 2-3.

The movable contactor 2 may be rotatable to a first position where it contacts the stationary contactor 1 of FIG. 1, and a second position where it is separated from the stationary contactor by an electromagnetic repulsive force upon occurrence of a large fault current on a circuit.

Here, the first curved surface 2-1 is a curved surface which is affected by an elastic force of the spring 4, which is applied toward the contact (see 2*b* of FIG. 2), via the contact lever 3 when the movable contactor 2 is located at the first position. While a contact surface 3*a*1 of the contact lever 3 contacts the first curved surface 2-1, the first curved surface 2-1 of the movable contactor 2 receives as contact pressure the elastic force of the spring 4, which is applied toward the contact 2*b* of the movable contactor 2, such that the movable contactor can stably maintain the contact state with the stationary contactor 1.

As the movable contactor 2 rotates from the first position to the second position, the second curved surface 2-2 receives the elastic force of the spring 4, which starts to be applied in a direction closer to a center shaft of the movable contactor 2 (see the movable contactor center pin 6 of FIG. 1) than toward the contact 2*b* of the movable contactor 2, via the contact lever 3. The second curved surface 2-2 is a curved surface which is located closer to the contact 2*b* of the movable contactor 2 than the first curved surface 2-1.

When an electromagnetic repulsive force is generated between the movable contactor 2 and the stationary contactor 1 due to occurrence of a large fault current, such as a short-circuit current, on an electric power circuit connected to the circuit breaker, the movable contactor 2 is rotated to the second position separated from the stationary contactor 1 and accordingly the contact surface 3*a*1 of the contact lever 3 is moved away from the first curved surface 2-1 and contacts the second curved surface 2-2. While the contact surface 3*a*1 of the contact lever 3 contacts the second curved surface 2-2, the elastic force of the spring, which was applied toward the contact (see 2*b* of FIG. 2) of the movable contactor 2, as shown in FIG. 5, starts to be applied toward the center shaft of the movable contactor 2 (see the movable contactor center pin 6 of FIG. 1). Consequently, the elastic force of the spring 4 may drastically reduce contact pressure of the movable contactor 2. Thus, the movable contactor 2 can be kept separated from the stationary contactor 1 in spite of reduction of the electromagnetic repulsive force due to an increase in an opened distance (i.e., a separated distance between a contact of the movable contactor and a contact of the stationary contactor).

The third curved surface 2-3 receives the elastic force of the spring, which is applied toward the center shaft of the movable contactor 2 in response to the rotation of the movable contactor 2 from the first position to the second position, via the contact lever 3. The curved surface 2-3 is a curved surface located closer to the contact of the movable contactor 2 than the second curved surface 2-2. While the contact surface 3*a*1 of the contact lever 3 contacts the third curved surface 2-3 as the movable contactor 2 is further rotated to the second position separated from the stationary contactor 1, the elastic force of the spring 4 is fully applied towards the center shaft (i.e., the movable contactor center pin 6 of FIG. 1). Hence, the elastic force of the spring 4 may attenuate a moment that the movable contactor 2 is intended to return to the first position (i.e., to a closed state) responsive to a drastic reduction of the electromagnetic repulsive force, and allow for maintenance of an open state (i.e., the separated state of the movable contactor from the stationary contactor) for a limited time by a frictional force between the third curved surface 2-3 and the contact lever 3. Here, the limited time is longer than a time taken for performing a trip operation, which a switching mechanism is run by a fault current detection and thusly-performed triggering of a trip mechanism (not shown) to rotate the shaft 7 so as to separate the movable contactor 2 from the stationary contactor 1.

The rotation of the movable contactor 2 to the first position may be executed in response to the rotation of the shaft 7 which supports the movable contactor 2.

The operation that the movable contactor 2 is separated from the stationary contactor 1 by the trip operation of the switching mechanism (not shown) may be executed by the rotation of the shaft 7 by a driving force transferred from the switching mechanism.

However, the rotation of the movable contactor 2 by the electromagnetic repulsive force upon occurrence of the large fault current on the circuit may be executed in an independent manner, irrespective of the driving force transferred from the shaft 7.

The shaft 7 is a short shaft member, and may rotatably support the movable contactor 2 located therein. To this end, the shaft 7 may include a receiving portion 7*d* to receive the movable contactor 2 therein. In order to allow the movable contact 2 to be independently rotatable by the electromagnetic repulsive force in a stopped state of the shaft 7, the receiving portion 7*d* of the shaft 7 may include an opened portion, which is open toward an outer circumferential surface of the shaft 7 by a predetermined angle. Therefore, prior to performing a trip mechanism upon occurrence of a large current on a circuit, the movable contactor 2 can be rotated to the second position where it is separated from the stationary contactor 1 within an angle range of the opened portion of the receiving portion 7*d* by the electromagnetic repulsive force in the stopped state of the shaft 7.

Referring to FIG. 2, the shaft 7 may include contact lever pin hole portions 7*a* to support both ends of the contact lever pins 5, a pair of contact lever supporting recess portions 7*b* to rotatably support the respective contact levers 3, and second arcuate surfaces 7*b*1 each formed at one side of each contact lever supporting recess portions 7*b* to support a first arcuate surface 3*c*1 of the corresponding contact lever 3.

As can be seen in FIG. 2, the shaft 7 may also include a second center shaft hole portion 7*c* formed at its central portion. The movable contactor center pin 6 may be inserted into the corresponding second center shaft hole portion 7*c* through the first center shaft hole portion 2*c* of the movable contactor 2. The movable contactor center pin 6 may support the movable contactor 2 for prevention of separation and eccentric state of the movable contactor 2.

The shaft 7 may additionally include a pair of spring receiving recess portions 7*e* formed at both outer surfaces thereof (i.e., both outer plate surfaces) along a central portion of the shaft 7.

Still referring to FIG. 2, for prevention of interference between the movable is contact center pin 7 and the spring 4, a length $I_1$ of the movable contactor center pin 6 may be decided not to exceed a length $I_2$ of the second center shaft hole portion 7*c* of the shaft 7. This may be expressed by the following Formula (1).

$$I_1 \leq I_2 \quad (1)$$

Meanwhile, the pair of contact levers 3 may be configured as a pair of metal pieces each having a contact surface 3*a*1 which contacts the curved protrusion 2*a* of the movable contactor 2 and a pair of spring supporting recess portions 3*b*1. The pair of contact levers 3 may be symmetrically installed to each other based on the movable contactor 2.

Each of the pair of contact levers 3, as shown in FIG. 2, may comprise a pair of pin connecting protrusions 3*c* for connection of the contact lever pin 5, and first arcuate surfaces 3*c*1 formed at outer surfaces of the pair of pin connecting protrusions 3*c*, respectively.

Each of the pair of contact levers 3 may further comprise a body plate portion 3*a*, the pair of pin connecting protrusions 3*c*, and a spring supporting plate portion 3*b*.

The body plate portion 3*a* may be configured as a plate-like member defining a main body portion.

The pin connecting protrusions 3*c* correspond to a shaft receiving portion extending from the body plate portion 3*a* and bent backwardly and having shaft holes. In other words, the pin connecting protrusions 3*c* are members for connection of the contact lever pin 5 corresponding to a supporting shaft.

The spring supporting plate portion 3*b* may extend from one end of the body plate portion 3*a* to both sides thereof, and have the pair of spring supporting recess portions 3*b*1.

Referring to FIGS. 1 to 4, the spring is configured by a tension spring whose both end portions are supported by the spring supporting recess portions 3*b*1 of the pair of contact levers 3. The spring 4 may be received in a spring receiving recess 7*e* of the shaft 7. Each of the springs 4 may be provided correspondingly for each of both plate surfaces of the movable contactor 2.

The spring 4 may provide an elastic force, as contact pressure, to maintain the movable contactor 2 in the contact state with the stationary contactor 1 when the movable contactor 2 is located at the first position where it contacts the stationary contactor 1.

When the movable contactor 2 passes through a dead point while rotating toward the second position, the spring 4 may provide an elastic force in a direction that the movable contactor 2 is separated from the stationary contactor 1. That is, from the moment when the electromagnetic repulsive force between the movable contactor 2 and the stationary contactor 1 becomes larger than contact pressure of the spring 4 due to occurrence of a large fault current such as a short-circuit current on the circuit, the movable contactor 2 is rotated to the second position where it is separated form the stationary contactor 1. Starting from the moment when the contact surface 3*a*1 of the contact lever 3 is moved away from the first curved surface 2-1 and contacts the second curved surface 2-2 (i.e., starting from the dead point) in response to the rotation of the movable contactor 2, the elastic force of the spring 4, as shown in FIG. 5, starts to be applied in a direction close to the center shaft of the movable contactor 2 (i.e., the movable contactor center pin 6) other than toward the contact (see 2*a* of FIGS. 1 and 2) of the movable contactor 2. The elastic force may be applied such that the movable contactor 2 can be separated from the stationary contactor 1.

In the meantime, as shown in FIGS. 1 to 4, each of the contact lever pins 6 may be passed through the corresponding contact lever 3 such that its both end portions can be supported at the shaft 7, thereby providing a rotation supporting point to the contact lever 3. In other words, the contact lever pin 5 may be passed through the shaft holes of the pin connecting protrusions 3*c* such that both end portions thereof can be inserted into and supported by the contact lever pin hole portion 7*a* of the shaft 7.

Hereinafter, description will be given of an operation of the movable contactor assembly for the current limiting type circuit breaker according to the exemplary embodiment having the configuration.

First, the operation of the movable contactor assembly for the current limiting type circuit breaker at the first position will be explained.

When a normal current flows on the circuit, to which the current limiting type circuit breaker is connected, and the current limiting type circuit breaker is located at a closing position, referring to FIG. 1, the contact 2*b* of the movable contactor 2 contacts the contact 1*a* of the stationary contactor 1. Here, referring to FIG. 2, the contact surface 3*a*1 of the contact lever 3 contacts the first curved surface 2-1, and the elastic force of the spring 4, which is applied toward the contact 2*b* of the movable contactor 2, functions as contact pressure. Hence, the movable contactor 2 can stably be maintained in the contact state with the corresponding stationary contactor 1.

Next, when an electromagnetic repulsive force generated between the movable contactor 2 and the stationary contactor 1 becomes stronger than contact pressure of the spring 4 because a large fault current such as a short-circuit current flows on the circuit to which the circuit breaker is connected, the movable contactor 2 starts to be rotated to the second position where it is separated from the stationary contactor 1. Such current limiting operation will be described hereinafter.

As the movable contactor 2 is rotated to the second position where it is separated from the stationary contactor 1, while the contact surface 3*a*1 of the contact lever 3 is moved away from the first curved surface 2-1 and contacts the second curved surface 2-2, the elastic force of the spring 4 is not applied any more toward the contact 2*b* of the movable contactor 2 and starts to be applied in a direction close to the center shaft of the movable contactor 2 (i.e., the movable contactor center pin 6 of FIG. 1). Hence, the elastic force of the spring 4 remarkably reduces contact pressure of the movable contactor 2, and thus the movable contactor 2 is continuously separated from the stationary contactor 1, in spite of reduction of the electromagnetic repulsive force in response to an increase in the open distance (i.e., the separated distance between the contact of the movable contactor and the contact of the stationary contactor), thereby limiting a fault current.

While the contact surface 3*a*1 of the contact lever 3 contacts the third curved surface 2-3 in response to the further rotation of the movable contactor 2 to the second position where it is separated from the stationary contactor 1, the elastic force of the spring 4 is fully applied toward the center shaft (i.e., the movable contactor center pin 6 of FIG. 1), so as to attenuate a moment that the movable contactor 2 is intended to return to the fist position due to a drastic reduction of the electromagnetic repulsive force. Accordingly, the open state (i.e., the separated state of the movable contactor from the stationary contactor), namely, a current-limited state is maintained for a limited time. Here, the limited time is longer than a time taken for performing a trip operation, which a switching mechanism is run by a fault current detection and thusly-performed triggering of a trip mechanism (not shown) to rotate the shaft 7 so as to separate the movable contactor 2 from the stationary contactor 1.

As described above, according to the movable contactor assembly for the current limiting type circuit breaker, with the configuration of the movable contactor 2 including the curved protrusion 2*a* having the first curved surface 2-1, the second curved surface 2-2 and the third curved surface 2-3, the springs 4 and the contact levers 3, the elastic force of the spring 4 is applied to the movable contactor 2 as contact pressure with the stationary contactor 1 at the first position, while being applied to the movable contactor 2 to be separated from the stationary contactor 1 during a current limiting operation and maintaining the separated state at the second position for a sufficient time, whereby a fault current can be limited enough until a trip operation is executed by the trip mechanism and the switching mechanism and until arc is extinguished by an arc-extinguishing mechanism.

Also, the movable contactor assembly for the current limiting type circuit breaker can provide effects of improving assembly productivity and reducing fabricating costs by virtue of employing a single spring 4 for each side surface (each plate surface) of the movable contactor 2 and a simplified configuration without a spring supporting pin.

In the movable contactor assembly for the current limiting type circuit breaker according to the invention, the movable contactor 2 comprises the first center shaft hole portion 2*c* formed in form of a long hole at a central position in a lengthwise direction and a height direction, and the shaft 7 comprises the second center shaft hole portion 7*c* formed at a central portion thereof. The movable contactor assembly may further comprise a movable contactor center pin 6, which supports the movable contactor 2 for prevention of separation and eccentric state thereof and is inserted into the first center shaft hole portion 2*c* of the movable contactor 2 and the second center shaft hole portion 7*c* of the shaft 7, thereby effectively preventing the center of the movable contactor 2 from being moved during the current limiting operation.

In the movable contactor assembly for the current limiting circuit breaker, since the length $I_1$ of the movable contactor center pin 6 does not exceed the length $I_2$ of the center shaft hole 7*c* of the shaft 7, no interference may occur between the movable contactor center pin 6 and the spring 4.

In the movable contactor assembly for the current limiting circuit breaker, each contact lever 3 comprises the pin connecting protrusions 3*c* for connection of the contact lever pin 5 and the first arcuate surfaces 3*c*1 formed at the outer surfaces of the pin connecting protrusions 3*c*, and the shaft 7 includes the contact lever supporting recess portions 7*b* to rotatably support the contact lever 3, and the second arcuate surfaces 7*b*1 each formed at one side of each contact lever supporting recess 7*b* to support the first arcuate surface 3*c*1 of the corresponding contact lever 3, whereby the contact lever 3 can be stably rotatably supported by the shaft 7 based on the contact lever pin 5.

In the movable contactor assembly for the current limiting circuit breaker, since each of the pair of contact levers includes one body plate portion 3*a*, the pair of pin connecting protrusions 3*c* extending from the body plate portion 3*a* and bent backwardly for connection of the contact lever pin 5, and the spring supporting plate portion 3*b* having a pair of spring supporting recess portions 3*b*1, one contact lever 3 can support ends of the pair of springs 4, which allows one movable contactor assembly to be provided with only the pair of springs 4, thereby reducing the number of components, as compared to the related art requiring four springs for one movable contactor assembly. This results in improvement of productivity and reduction of fabricating cost.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A movable contactor assembly for a current limiting type circuit breaker having a current limiting type stationary contactor, the movable contactor assembly comprising:

a movable contactor having a pair of curved protrusions having cam profiles, respectively, symmetrically formed at upper and lower surfaces thereof, the movable contactor being rotatable to a first position contacting the current limiting type stationary contactor, and a second position separated from the current limiting type stationary contactor by an electromagnetic repulsive force upon occurrence of a large fault current on a circuit, wherein the movable contactor has contacts at both end portions thereof;

a shaft to rotatably support the movable contactor located therein, the shaft having a pair of spring receiving recess portions formed at outer surfaces along a central portion thereof;

a pair of contact levers each having a contact surface contactable with the curved protrusion of the movable contactor and a pair of spring supporting recess portions, the pair of contact levers being symmetrically installed based on the movable contactor;

a pair of springs each having both end portions supported by the spring supporting recess portions of the corresponding contact lever, received in the spring receiving recess portions of the shaft, and provided respectively at both plate surfaces of the movable contactor, the pair of springs applying an elastic force as contact pressure for maintaining a contact state between the movable contactor and the current limiting type stationary contactor when the movable contactor is located at the first position, and applying the elastic force in a direction to separate the movable contactor from the current limiting type stationary contactor when the movable contactor is moved over a dead point while rotating toward the second position; and a pair of contact lever pins inserted through the contact levers, respectively, such that both ends thereof are supported by the shaft so as to provide rotation supporting points to the corresponding contact levers, wherein each cam profile of the movable contactor comprises:

a first curved surface to receive, via the contact lever, the elastic force of the springs applied toward the contact of the movable contactor when the movable contactor is located at the first position;

a second curved surface to receive, via the contact lever, the elastic force of the springs, which starts to be applied in a direction close to a center shaft of the movable contactor, other than toward the contact of the movable contactor, while the movable contactor is rotated from the first position toward the second position, the second curved surface being located closer to the contact of the movable contactor than the first curved surface; and a third curved surface to receive, via the contact lever, the elastic force of the spring applied toward the center shaft of the movable contactor while the movable contactor is rotated from the first position toward the second position, the third curved surface being located closer to the contact of the movable contactor than the second curved surface.

2. The assembly of claim 1, wherein the movable contactor comprises a first center shaft hole portion formed in a shape of a long hole at a central position in a lengthwise direction and a height direction thereof, wherein the shaft comprises a second center shaft hole portion formed at a central portion thereof, and wherein the movable contactor assembly further comprises a movable contactor center pin to support the movable contactor for prevention of separation and eccentric state, the movable contactor center pin being inserted into the first center shaft hole portion of the movable contactor and the second center shaft hole portion of the shaft.

3. The assembly of claim 2, wherein a length of the movable contactor center pin is equal with or shorter than a length of the second center shaft hole portion of the shaft for prevention of interference between the movable contactor center pin and the springs.

4. The assembly of claim 1, wherein each of the pair of contact levers comprises:

a pair of pin connecting protrusions for connection of the contact lever pins; and first arcuate surfaces formed at outer surfaces of the pair of pin connecting protrusions, respectively, wherein the shaft comprises:

a pair of contact lever supporting recess portions to rotatably support the respective contact levers; and second arcuate surfaces each formed at one side of the corresponding contact lever supporting recess portion to support the first arcuate surface of the corresponding contact lever.

5. The assembly of claim 1, wherein each of the pair of contact levers comprises:

a body plate portion;

a pair of pin connecting protrusions extending from the body plate portion and bent backwardly for connection of the contact lever pin; and a spring supporting plate portion extending from one end of the body plate portion toward both sides, and having a pair of spring supporting recess portions.

* * * * *